US005294057A

United States Patent [19]

Hamilton

[11] Patent Number: 5,294,057

[45] Date of Patent: Mar. 15, 1994

[54] SOLENOID OPERATED LIQUID SPRAY GUN

[75] Inventor: Richard J. Hamilton, West Chicago, Ill.

[73] Assignee: Spraying Systems Co., Wheaton, Ill.

[21] Appl. No.: 871,923

[22] Filed: Apr. 21, 1992

[51] Int. Cl.[5] ..... B05C 7/02

[52] U.S. Cl. ..... 239/417.3; 239/583; 239/600; 118/317

[58] Field of Search ..... 239/583, 407, 413, 416.4, 239/417.3, 416.5, 417.5, 128, 132.5, 600, 585.5; 118/306, 317, DIG. 10

[56] References Cited

U.S. PATENT DOCUMENTS 2,895,449 7/1959 Oldfield, Jr. ..... 118/317
3,212,715 10/1965 Cocks ..... 239/583
3,680,794 8/1972 Romann et al. ..... 239/585.5
3,921,570 11/1975 Hogstrom et al. ..... 118/317
4,180,011 12/1979 Halicki ..... 118/317
5,078,325 1/1992 Waryu et al. ..... 239/583

*Primary Examiner*—Karen B. Merritt
*Attorney, Agent, or Firm*—Leydig, Voit & Mayer, Ltd.

[57] ABSTRACT

A solenoid operated liquid spray gun for use in directing small volume, air atomized liquid at short operating intervals. The spray gun includes a housing having pressurized liquid and air inlets, a solenoid coil contained within the housing, and a fluid control module disposed within the solenoid coil for controlling the flow of liquid from the liquid inlet through a discharge nozzle. The solenoid coil and module further define an annular air passage within the housing for communicating pressurized air from the air inlet to the nozzle for facilitating atomization and direction of the liquid discharging from the gun.

39 Claims, 3 Drawing Sheets

SOLENOID OPERATED LIQUID SPRAY GUN

FIELD OF THE INVENTION

The present invention relates generally to spray guns for directing small volume, finely-atomized liquid at short operating intervals, and more particularly, to such spray guns that have particular applicability for use in continuous three-piece can manufacturing operations.

BACKGROUND OF THE INVENTION

The use of metal cans has been a cost effective means for packaging and preserving a wide range of products, from chemicals to foods. A common container used for this purpose is the three-piece can, consisting of two ends and a cylindrical body typically fabricated out of thin sheet steel.

High volume can making machinery is used to produce such containers. The body of the can is made by forming a flat sheet of steel into cylindrical shape and then welding the longitudinal joined edges together. Prior to forming the cylindrical body, a protective coating is applied to both sides of the sheet material to inhibit corrosion of the metal from the contents of the can and from the outside environment. The coating also prevents interaction of the metal with the contents, which could result in contamination or spoilage. The protective coating is applied to both sides of the sheet stock, but is held short of the two edges to be welded together which require bare metal-to-metal contact.

In the can body making operation, can machinery forms the cylinder over an arm or mandrel and then welds the side seam. At this stage of the process, a strip of bare metal on both the internal and external sides of the weld remains to be coated in order to provide complete protection on all surfaces. Respective spray guns are typically used to apply a narrow width stripe of protective coating to the area of the welded seam on both inner and outer sides thereof. As the cylindrical can body passes over the welding arm, the internal coating stripe is applied by a spray gun mounted on the end of the mandrel over which the cylindrical can body passes and the external coating stripe is applied to the outside of the weld seam by means of a second externally mounted spray gun.

While various spray guns have been used for this purpose, they have been relatively complex in construction, have been problem prone, and have not leant themselves to easy field service and maintenance. Some spray guns in current use, for example, operate from a source of compressed air. When the gun operates, a stream of coating material is ejected from the nozzle and mixed with air to create a finely atomized spray to coat the weld seam as the can body travels past the spray gun. In some instances, space limitations require a single air supply line to be used for operating the gun and atomizing the liquid. In order to prevent splattering of the coating as it impinges against the can body, a proper air-to-liquid pressure must be maintained. However, the minimum pressure required to operate the on/off mechanism of the gun may not be optimum for atomizing the spray. This can result in the excessive application and splattering of coating material. Air assisted spray guns of such type also employ seals about a movable valve plunger or needle that controls starting and stopping of the liquid spray, and such seals are susceptible to wear and require periodic replacement and maintenance.

Another type of spray gun in current use is a solenoid operated device, using high pressure liquid to coat the welded seam area. No air is needed for atomization since the relatively high pressure difference between the fluid and the atmosphere causes the necessary atomization. However, the volume of spray needed to cover a narrow weld strip area is very small. A problem with high pressure hydraulic atomization is that in order to effect such narrow width spraying a relatively small orifice must be used, which is susceptible to clogging and results in frequent maintenance and downtime of the production line. Solenoid operated spray guns heretofore have not been used for low pressure air-assisted spraying in can manufacturing lines because of the difficulty in directing both liquid and air supplies through the gun while maintaining a streamlined profile sufficient to permit the passage of cylindrical can bodies over the gun. Electrical solenoids also generate heat which can be difficult to dissipate in such restricted environment.

Leakage or other malfunctions in the operating parts of such spray guns also can cause the high speed can manufacturing lines to be shut down while servicing is accomplished. If removal of the gun from the manufacturing line is required, the fluid, air, and/or electric lines must be disconnected and the gun removed from its mountings and replaced. This can be a time consuming and costly procedure.

OBJECTS AND SUMMARY OF THE INVENTION

It is an object of the present invention to provide a streamlined spray gun adapted for low pressure spraying of small volume, finely atomized liquid at precisely controlled operating intervals. A related object is to provide a spray gun of such type which is adapted for installation and effective operation in automated three-piece can manufacturing lines.

Another object is to provide a spray gun as characterized above which is adapted for high speed cyclic operation.

A further object is to provide an air assisted spray gun of the above kind which has a modular construction that lends itself to easy field service and maintenance.

Still another object is to provide a solenoid operated, air-assisted spray gun which has a streamlined profile and is adapted for efficient heat dissipation even when utilized in restrictive environments.

Other objects and advantages of the invention will become apparent upon reading the following detailed description and upon reference to the drawings, in which:

Figures 1, 2:
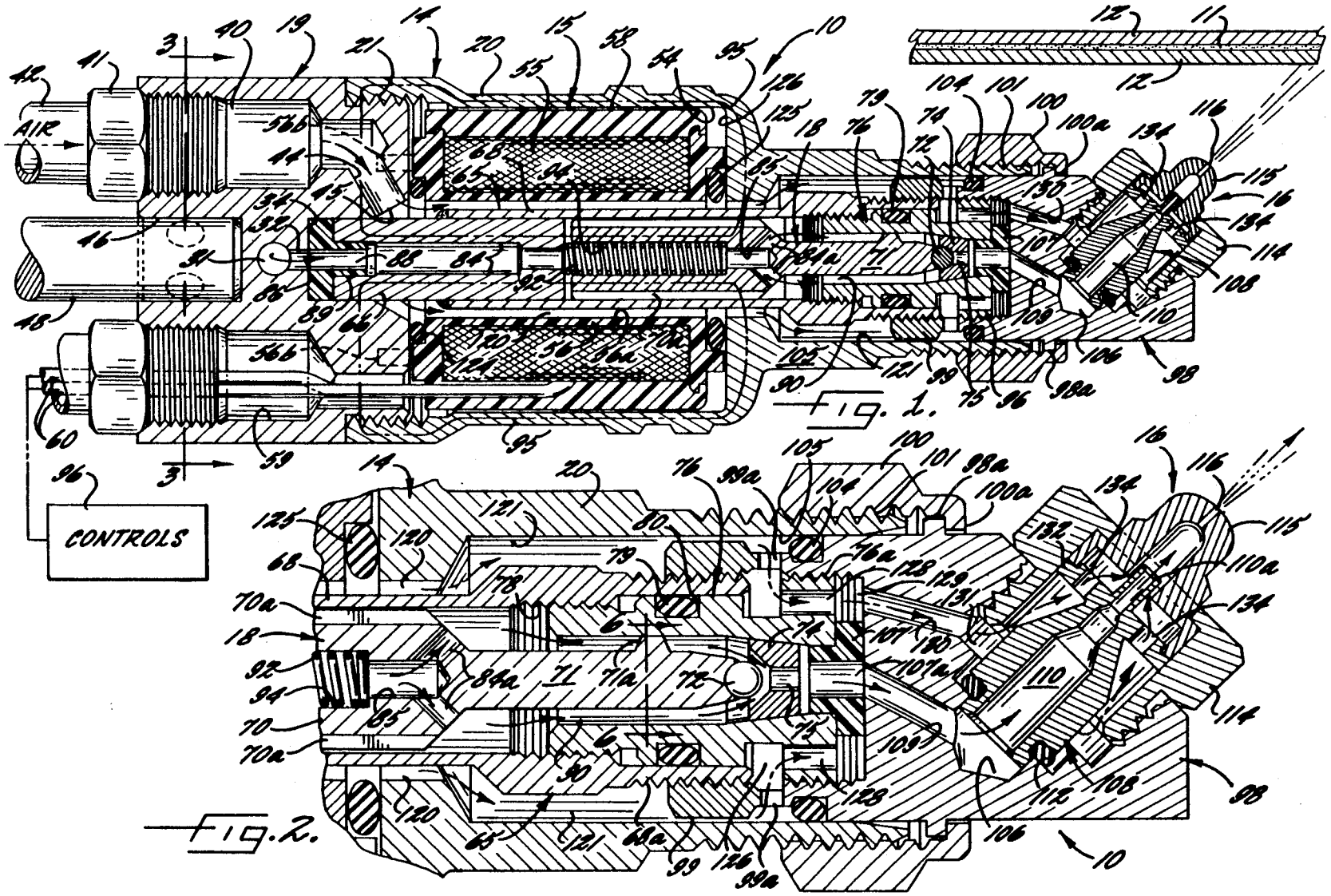
FIG. 1 is a longitudinal section of an illustrative spray gun embodying the present invention, taken in the plane of line 1—1 in FIG. 3.
FIG. 2 is an enlarged fragmentary section of the discharge end of the illustrated spray gun, showing the control valve thereof in an open position.

While the invention is susceptible of various modifications and alternative constructions, certain illustrated embodiments thereof has been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DESCRIPTION OF THE PREFERRED EMBODIMENTS

Referring now more particularly to FIG. 1 of the drawings, there is shown an illustrative spray gun 10 embodying the present invention diagrammatically depicted in a can manufacturing operation for directing a narrow width stripe of liquid spray, namely an anti-corrosive lacquer, onto the inner side of a weld seam 11 of a cylindrical can body 12 as the cylindrical can body 12 passes over the spray gun 10. It will be understood that a second spray gun of identical construction may be disposed externally of the cylindrical can body for similarly spraying a stripe of protective coating onto the outer exposed side of the weld seam.

The illustrated spray gun 10 includes a housing 14, a solenoid coil 15 contained centrally within the housing 14, a spray nozzle 16 supported at a discharge end of the housing 14, and a valve plunger 18 mounted for controlled reciprocal movement in response to operation of the solenoid coil 15 for controlling the discharge from the spray nozzle 16. The housing 14 has a two-part construction comprising a body 19 and an elongated generally cylindrical cover 20 mounted in forwardly extending relation to the body 19. The cover 20 in this instance is screwed onto an externally threaded downstream end 21 of the body 19.

Figure 3:
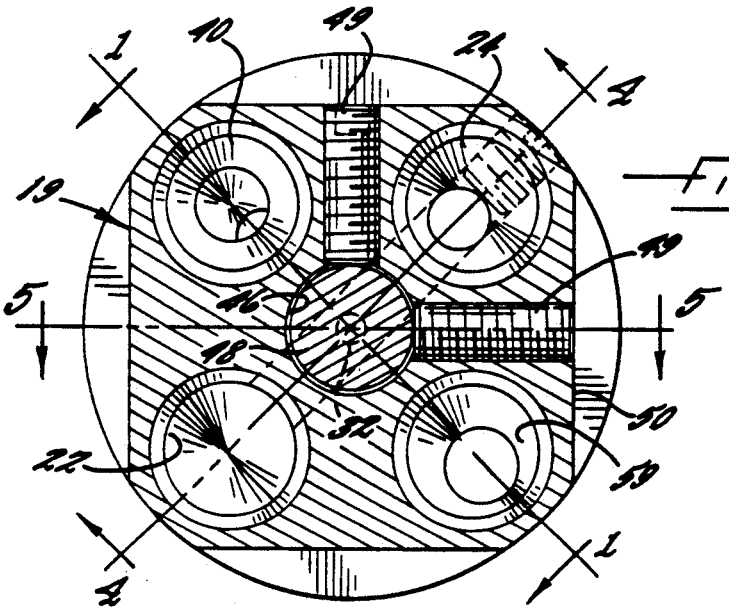
FIG. 3 is an enlarged section of the body of the spray gun taken in the plane of line 3—3 in FIG. 1.
Figure 4:
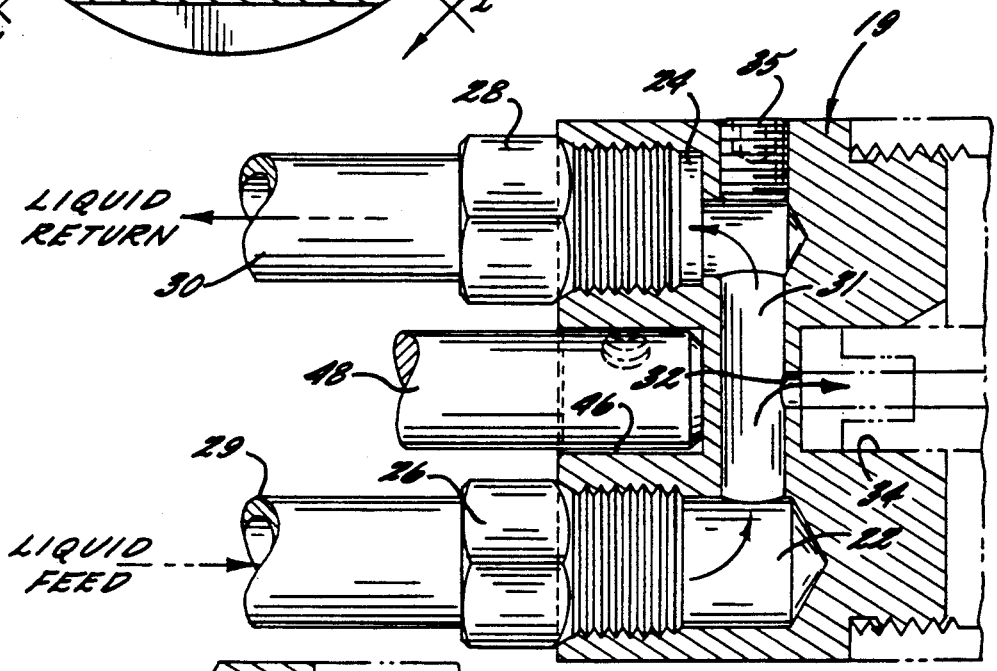
FIGS. 4 and 5 are sections of the body taken in the planes of lines 4—4 and 5—5 in FIG. 3, respectively.

The body 19 is formed with a pair of longitudinally extending liquid ports 22, 24 (FIGS. 3 and 4) on diametrically opposed sides of the body, each communicating with an upstream face 25 of the body and being internally threaded for receiving respective adaptors 26, 28 of liquid feed and return lines 29, 30, respectively. The liquid ports 22, 24 are connected by a cross-bore 31 which in turn communicates with a central liquid flow passage 32 that extends to a counterbore 34 formed in a downstream end of the body 19. To facilitate manufacture, the cross-bore 31 is formed by drilling a hole through one side of the body 19, which is then closed by a threaded plug 35 (FIG. 4). As is known in the art, supply liquid may be directed through the feed line 29 to the liquid port 22 with a portion thereof being directed through the return line 30 for continuous recirculation, such as to a heater for maintaining the liquid at an optimum temperature for spraying. In the event that recirculation is unnecessary or undesired, a plug 36 (FIG. 7) is threadedly engageable in the port 24 in lieu of the return line adaptor 28.

For communicating pressurized air to the body 19, the body 19 is formed with a longitudinal air inlet port 40 having a threaded upstream end for engagement by an adaptor 41 of an air supply line 42. The air inlet port 40 communicates through an angled passage 44 to a chamfered corner 45 adjacent a downstream end of the counterbore 34.

Figure 5:
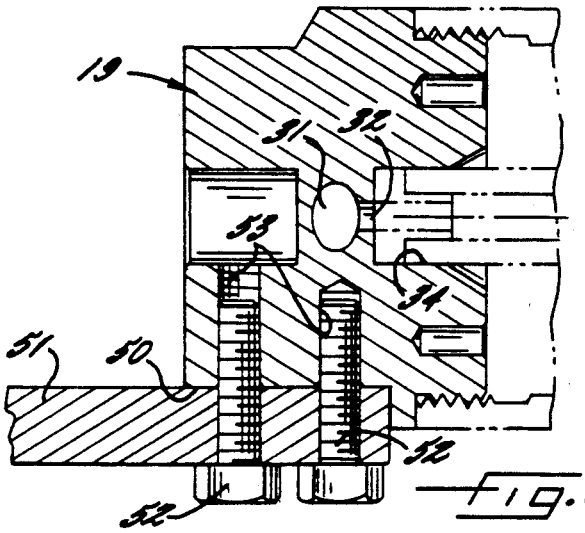
Figure 7:
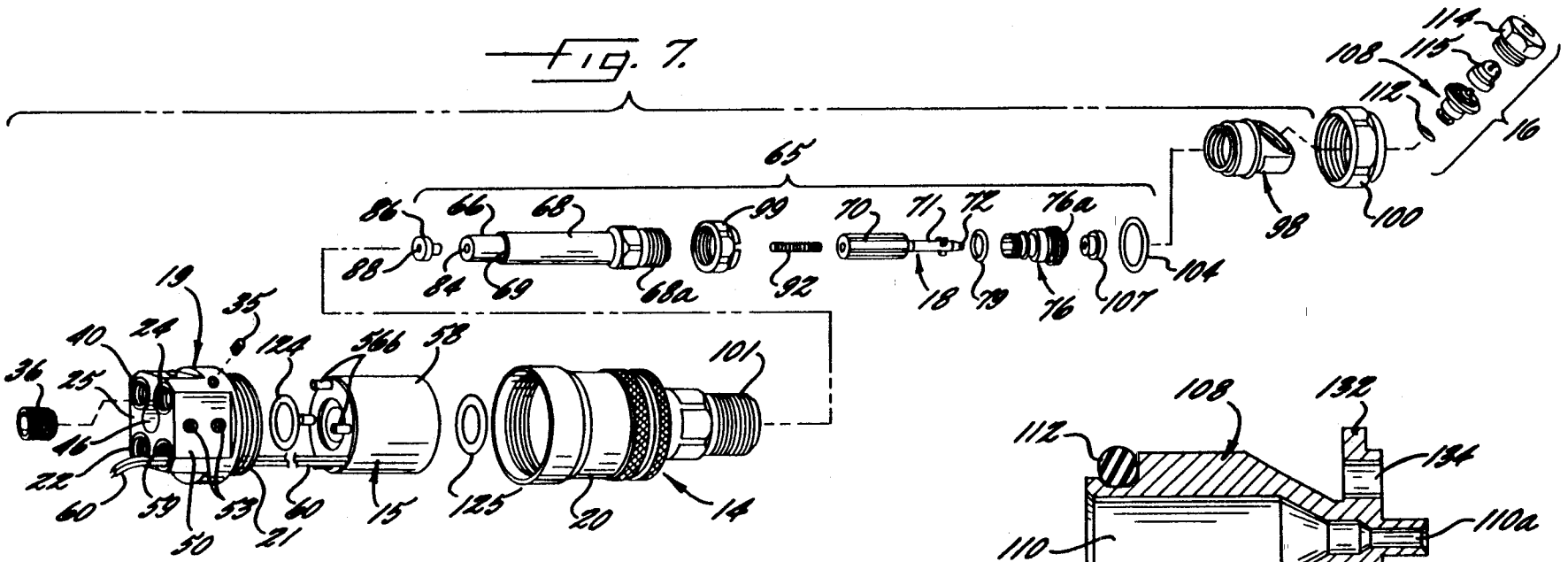
FIG. 7 is an exploded perspective of the spray gun parts.

To facilitate mounting of the spray gun 10, the body 19 is formed with a central mounting aperture 46 in its upstream end. The central mounting aperture 46 may be positioned on a support rod 48 and clamped thereto by means of set screws 49 (FIG. 3). For alternative mounting, the body 19 is formed with a flat upper surface 50 to permit securement to the underside of a bracket 51 or the like with fastening screws 52 extending through the support bracket into threaded engagement with apertures 53 extending into the body 19, as shown in FIGS. 5 and 7.

The cover 20 defines a forwardly extending cylindrical chamber 54 within which the solenoid coil 15 is contained. The solenoid coil 15 includes a conventional wound coil 55 about a plastic spool or bobbin 56 having an outer cylindrical cover 58. To enable connection of the coil wire 55 to an outside electrical source, the body 19 is formed with a further port 59 that extends longitudinally through the body 19 through which electrical leads 60 of the coil 55 exit the body 19.

In accordance with an important aspect of the invention, the valve plunger is part of a fluid control module that is coaxially positioned within the solenoid coil and which is easily removable and replaceable to permit convenient field service and maintenance to the spray gun. To this end, in the illustrated embodiment, the valve plunger 18 is included as part of a fluid control module 65 which includes a cylindrical metallic core 66, the upstream end of which is disposed within the counterbore 34 of the body 19, and a metallic cylindrical tube 68 secured to the core 66 in forwardly extending relation. The tube 68 in this instance is mounted in partially overlapping relation to the core 66 and is affixed thereto by a weld 69 about the upstream end of the tube 68. The plunger 18 is disposed within the tube 68 immediately downstream of the core 66 for limited relative longitudinal movement. The illustrated plunger 18 has an enlarged diameter, upstream-end 70 formed with a plurality of longitudinal grooves 70*a* for facilitating movement of the plunger. The plunger 18 has a forwardly extending nose or a needle portion 71 which has a ball 72, preferably made of tungsten carbide, brazed or otherwise affixed to the downstream end thereof.

When the valve plunger 18 is in a closed position, as shown in FIG. 1, the ball 72 is positioned in seated engagement with a valve seat 74 closing a central liquid orifice 75 therein. The valve seat 74, also preferably made of tungsten carbide, is coaxially carried by a seat plug 76 threadedly engageable at its upstream end with an internally threaded section 78 of the tube 68. An "O"-ring seal 79 is disposed within an outer annular groove 80 of the seat plug 76 in interposed relation between the seat plug 76 and the internal wall of the tube 68 (FIG. 2).

Figure 6:
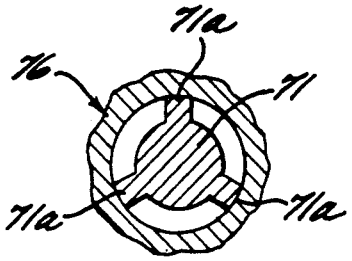
FIG. 6 is a fragmentary section of a nose portion of the valve plunger, taken in the plane of line 6—6 in FIG. 2.

For enabling communication of liquid through the control module 65, the core 66 and plunger 18 are formed with respective, concentric longitudinally extending liquid flow passageways 84, 85. A nylon gasket 86 formed with a central passageway 88 is disposed within the counterbore 34 of the body 19 in interposed relation between the body 19 and the upstream end of the core 66 for providing sealed communication of liquid between the body 19 and module 65. The illustrated gasket 86 is T-shaped, having a forwardly extending reduced diameter forward portion 89 press fit within a counterbore in the upstream end of the core 66. The longitudinal passage 84 in the plunger 18 communicates with a plurality of downstream outwardly angled flow passages 84a in the plunger, which in turn communicate with an annular liquid flow passage 90 defined between the plunger nose 71 and larger diameter cylindrical chambers in the tube 68 and seat plug 76 through which the nose 71 extends. The nose 71 of the plunger is formed with a plurality of circumferentially spaced, outwardly extending lobes 71a (FIG. 6) intermediate its ends which guide movement of the plunger nose 71 relative to the seat plug 76, while permitting the free passage of liquid along and around the nose 71 to the valve seat 74. For biasing the valve plunger 18 toward a closed position with the ball 72 closing the valve seat orifice 75, as shown in FIG. 1, a spring 92 is disposed within an enlarged counterbore section 94 of the longitudinal liquid flow passage 85 of the plunger in interposed relation between a shoulder of the plunger defined by the counterbore section 94 and a downstream end of the core 66.

By selectively energizing the solenoid coil 15, it will be seen that a flux loop 95 is generated through the core 66, plunger 18, cover 20, and body 19, as depicted by the circular paths 95 shown in FIG. 1, causing the valve plunger 18 to be moved rearwardly against the force of the biasing spring 92 to open the valve seat discharge orifice 75 and permit the flow of pressurized liquid therethrough. Such rearward or retractive movement of the plunger 18 is limited by engagement of the upstream end of the plunger 18 with the core 66. Deenergization of the solenoid coil 55 permits the valve plunger 18 to be returned to its closed position under the force of the biasing spring 92. It will be understood by one skilled in the art that by means of an appropriate control 96, diagrammatically indicated in FIG. 1, the plunger 18 may be cyclically operated so as to be in an open position and permit liquid discharge from the gun at intervals corresponding to the time individual cylindrical can bodies 12 pass over the discharge end of the gun 10.

For supporting the spray nozzle 16 in angled relation to the axis of the spray gun housing 14 so as to direct the discharging liquid at an angle, such as 45°, to the surface of the passing can body to minimize splattering, the nozzle assembly 16 is mounted in a tip adaptor 98 secured in forwardly extending relation to the seat plug 76. The tip adaptor 98 in this case is threadedly engageable with an externally threaded end 76a of the seat plug 76. For securing the tip adaptor 98 in proper mounted position on the seat plug, a jamb nut 99 is threaded onto an enlarged downstream end 68a of the module tube 68 and engages the upstream end of the tip adaptor 98.

For retaining the module 65 in the gun for easy removal and replacement, a removable retainer cap 100 is screwed onto an externally threaded downstream end 101 of the cover 20. In the illustrated embodiment, the retainer cap 100 has an annular end portion 100a engaging an annular outwardly extending radial flange 98a of the tip adaptor 98. A sealing "O"-ring 104 is mounted in interposed relation between an upstream neck of the tip adaptor 98 and an internal wall 105 of a forwardly opening chamber defined by the cover 20 at the downstream end thereof.

Figure 8:
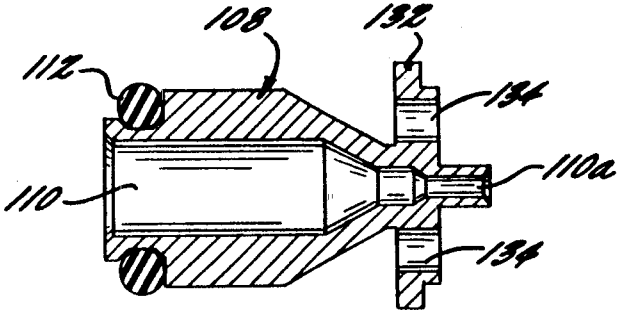
FIG. 8 is an enlarged section of the fluid tip of the nozzle of the illustrated spray gun.

The tip adaptor 98 is formed with an outwardly opening chamber 106 within which a fluid tip 108 is supported with its axis at an angle of 45° to the axis of the body of the spray gun. The tip adaptor 98 is further formed with a liquid flow passage 109 communicating between a discharge side of the valve seat orifice 75 and an upstream end of the chamber 106. A T-shaped nylon gasket 107 having a central flow passage 107a is interposed between the downstream end of the seat plug 76 and the tip adaptor 98 with an upstream end thereof press fit into a cylindrical chamber of the seat plug 76 in coaxial relation to the valve seat 74 for providing for sealed passage of liquid from the valve seat discharge orifice 75 to the tip adaptor liquid flow passageway 109. The fluid tip 108 is formed with a central liquid flow passage 110 which terminates at its downstream end in a cylindrical discharge orifice 110a (FIGS. 2 and 8). An "O"-ring 112 provides a seal between an upstream base of the nozzle tip 108 and the tip adaptor chamber 106. The fluid tip 108 is secured by a retainer cap 114 that is threadedly engageable with the outwardly opening end of tip adapter chamber 106. An air cap 115 having a discharge orifice 116 also is secured by the retainer cap 114 immediately downstream of the fluid nozzle 108.

In carrying out a further aspect of the invention, the fluid control module and the solenoid coil define a central air passageway extending through the coil for communicating pressurized air from the air inlet port to the spray nozzle. To this end, the outer periphery of the module 65 and an internal cylindrical opening 56a of the coil spool 56 define an annular air flow passageway 120 communicating between the air inlet passages 40, 44 in the body 19 from the chamfered corner 45 thereof centrally through the solenoid coil 15 and into an annular passageway 121 defined between the outer periphery of the module 65 and the cylindrical wall 105 defined by the downstream end of the cover 20.

For sealing the air passageway 120, an "O"-ring 124 is interposed between an upstream end of the coil spool and an end wall of the body 19 and a second "O"-ring 125 is interposed between an upstream end of the spool and an internal end wall 126 of the cover 20. As the cover 20 is screwed into engaging relation with the body 19, the "O"-rings 124, 125 are compressed into sealing engagement between the bobbin and housing. The "O"-ring 104 seals the downstream end of the annular passage 121. To prevent rotation of the solenoid coil 15 during assembly of the cover 20 onto the body 19, and hence, to prevent stress and twisting of the leads 60 of the solenoid coil, the coil spool 56 has longitudinally extending lugs 56b received in respective apertures in the downstream end of the body 19.

In order to permit communication of pressurized air from the annular passage 121 to the nozzle 16, the jamb nut 99 is formed with radial passages 99a communicating with an annular air passageway 126 formed in the seat plug 76 which in turn communicates with a plurality of longitudinal passages 128, which in turn communicate with an annular air chamber 129 defined by the tip adaptor 98 about the outer periphery of the sealing gasket 107. Pressurized air communicates through a plurality of passages 130 in the tip adaptor 98, one of which is shown, from the annular chamber 129 to an annular air chamber 131 about the outer periphery of the fluid nozzle 108 upstream of an outwardly extending annular flange 132 thereof. Pressurized air passes axially through a plurality of circumferentially spaced apertures 134 in the nozzle tip flange 132 and such air streams then are directed into converging relation with the liquid flow stream emitted from the discharge orifice 110*a* of the fluid nozzle 108 to the facilitate atomization of the discharging liquid and the direction thereof through the discharge orifice 116 in the air cap 115, which in this case is formed by a cross slot in the end of the air cap for producing a flat narrow width spray pattern.

It will be appreciated by one skilled in the art that a small volume, finely atomized spray may be generated with relatively low air pressure, so as to permit the use of sufficiently large air cap and fluid tip discharge orifices to prevent the tendency for clogging of the orifices, even after periods of shut down. The low atomizing air pressure also enables the efficient distribution of a relatively narrow width small volume spray discharge, such as ⅜ inch in width, without undesirable splattering. Controlled intermittent operation of the solenoid coil 15 further enables the spray gun to be operated at predetermined relatively short intervals, corresponding to the time respective cylindrical can bodies pass over the discharge end of the spray gun. The flow of pressurized air through the passages 120, 121 centrally through the solenoid coil 15 also tends to dissipate heat generated by the solenoid coil, which could otherwise become excessive in the restrictive can spraying environment.

Figure 9:
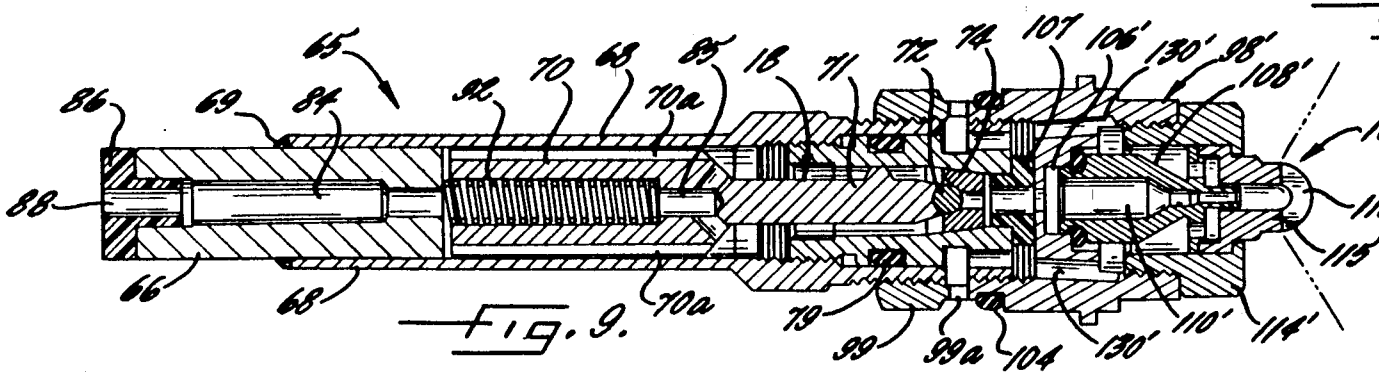
FIG. 9 is a longitudinal section of the fluid module of the illustrated spray gun showing an alternative of nozzle mounting.

The spray gun 10 further lends itself to easy field service repair and maintenance, which can be quickly effected as on-line repair without disconnecting any fluid, air or electric lines or disturbing the mounting of the gun. For this purpose, the fluid control module 65 is easily removable and replaceable as a whole upon simple removal of the retainer cap 100. The control module 65 with the tip adaptor 98 and nozzle assembly 16 intact may be easily removed and replaced with a new unit (FIG. 9). Since the fluid control module 65 includes the relatively moveable parts and defines the most restrictive liquid and air flow passages, replacement of the module usually will rectify most field service problems.

While in the illustrated embodiment, the tip adaptor 98 supports the liquid spray tip 108 and air cap 115 at a 45° angle to the axis of the spray gun housing to facilitate direction of the discharging spray onto the weld seam 11 of the cylindrical can body 12 which is being directed over the spray gun, alternatively, it will be understood that a tip adaptor 98' may be used in which a fluid spray tip 108' and air cap 115' discharge spray in a longitudinal direction, as depicted in a FIG. 9, wherein similar items have been given similar reference numerals with the distinguishing suffix "'" added. Such arrangement may be used for spraying applications in which the gun may be mounted to permit longitudinal direction of the discharging spray.

From the foregoing, it can be seen that the spray gun of the present invention has a streamlined profile and is adapted for low pressure spraying of small volume, finely atomized liquid at precisely controlled operating intervals, and hence, is particularly adapted for use in can manufacturing lines. Moreover, its modular construction facilitates easy field service and maintenance.

What is claimed is:

1. A liquid spray gun comprising a housing, means defining a liquid inlet for connection to a pressurized liquid supply source, a discharge nozzle, a solenoid coil supported within said housing, means for electrically coupling said solenoid coil to an electrical source, a fluid control module disposed within said solenoid coil for controlling the flow of liquid from said liquid inlet defining means through said nozzle, said control module defining a liquid passage for communicating liquid from said liquid inlet defining means to said nozzle and including a valve plunger movable between a first position for preventing the flow of liquid through said nozzle and a second position for permitting the flow of liquid from said liquid inlet defining means and through said nozzle for direction from said gun, said solenoid coil being selectively operable for moving said plunger between said first and second positions, said control module being removable and replaceable in said housing, a retaining member releasably engageable with said housing for securing said control module in said housing, and said control module being removable from said housing upon disengagement of said retaining member from said housing.

2. The liquid spray gun of claim 1 in which said control module includes spring means for biasing said valve plunger to said first position.

3. The liquid spray gun of claim 1 in which said housing includes means for defining an air inlet for connection to a pressurized air source, and means defining an air passage for communicating pressurized air from said air inlet defining means to said nozzle for assisting in atomization and direction of liquid spray from said discharge nozzle.

4. The liquid spray gun of claim 1 in which said housing has a two-part construction comprising a body and a removable elongated cover.

5. The liquid spray gun of claim 1 in which said housing includes means defining an air inlet for connection to a pressurized air source, said nozzle including a fluid tip through which liquid is directed, an air cap mounted downstream of said fluid tip and being formed with a discharge orifice, and means in said housing defining an air passage for communicating pressurized air from said air inlet defining means to said air cap for assisting in atomization and direction of liquid discharging from said fluid tip.

6. The spray gun of claim 1 in which said nozzle is removably secured to an end of said module.

7. The spray gun of claim 6 in which said module is removably retained within said housing with said nozzle extending outwardly therefrom.

8. The liquid spray gun of claim 1 in which said retaining member is a retainer cap threadedly engageable with said housing.

9. The liquid spray gun of claim 1 in which said control module includes a valve seat having a liquid discharge orifice, and said valve plunger being positionable into and out of engagement with said valve seat for closing and opening said liquid discharge orifice.

10. The liquid spray gun of claim 9 in which said nozzle is supported on a discharge end of said module.

11. The liquid spray gun of claim 10 in which said housing includes means for defining an air inlet for connection to a pressurized air source, and means defining an air passage for communicating pressurized air from said air inlet defining means to said nozzle for assisting in atomization and direction of liquid spray from said discharge nozzle.

12. A liquid spray gun comprising a housing, means in said housing defining a liquid inlet for connection to a pressurized liquid source, means in said housing defining an air inlet for connection to a pressurized air source, a discharge nozzle at an end of said housing, means defining a liquid flow passage for communicating liquid from said liquid inlet to said nozzle, a solenoid coil supported within said housing, means for electrically coupling said solenoid coil to an electrical source, a liquid control module defining a liquid passage for communicating liquid from said liquid inlet defining means to said nozzle and including a valve plunger that is movable between a first position for preventing the flow of liquid through said nozzle and a second position for permitting the flow of liquid from said inlet defining means and through said liquid flow passage and nozzle for direction from said spray gun, said solenoid coil being selectively operable for moving said control valve plunger between said first and second positions, means defining an air flow passage within said housing for communicating pressurized air from said air inlet defining means to said nozzle for facilitating atomization and direction of liquid directed from said gun, said control module being removable and replaceable in said housing, a retaining member releasably engageable with said housing for securing said control module in said housing, and said control module being removable from said housing upon disengagement of said retaining member from said housing.

13. The spray gun of claim 12 in which said nozzle is removably secured to an end of said module, and said module is removably retained within said housing with said nozzle extending outwardly therefrom.

14. In a can manufacturing operation in which cylindrical can bodies having a longitudinal welded seam are successively passed over a spray gun which directs a strip of atomized protective liquid over the welded seam area, said spray gun comprising a housing, means defining a liquid inlet for connection to a pressurized liquid supply source, a discharge nozzle, a solenoid coil supported within said housing, means for electrically coupling said solenoid coil to an electrical source, a solenoid operated control module defining a liquid passage for communicating liquid from said liquid inlet defining means to said nozzle and for controlling the flow of liquid from said inlet through said nozzle, said solenoid coil being selectively energizable for operating said control module, said control module being removable and replaceable in said housing, a retaining member releasably enageable with said housing for securing said control module in said housing, and said control module being removable from said housing upon disengagement of said retaining member from said housing.

15. The liquid spray gun of claim 14 in which said housing includes means for defining an air inlet for connection to a pressurized air source, and means defining an air passage for communicating pressurized air from said air inlet defining means to said nozzle for assisting in atomization and direction of liquid spray from said discharge nozzle.

16. The liquid spray gun of claim 14 in which said housing has a two-part construction comprising a body and a removable elongated cover.

17. The liquid spray gun of claim 16 in which said body is formed with a counterbore opening in an downstream direction, and said control module is mounted with an upstream end disposed in said counterbore.

18. The liquid spray gun of claim 14 in which said housing includes means defining an air inlet for connection to a pressurized air source, said nozzle including a fluid tip through which liquid in said liquid inlet defining means is directed, an air cap mounted downstream of said fluid tip and being formed with a discharge orifice, and means in said housing defining an air passage for communicating pressurized air from said air inlet defining means to said air cap for assisting in atomization and direction of liquid discharging from said fluid tip.

19. A liquid spray gun comprising a housing, means defining a liquid inlet for connection to a pressurized liquid supply source, a discharge nozzle at an end of said housing, a solenoid coil supported within said housing, means for electrically coupling said solenoid coil to an electrical source, a fluid control module removably and replaceably mounted in said housing for controlling the flow of liquid from said inlet defining means through said nozzle, said control module including a valve plunger movable between a first position for preventing the flow of liquid through said nozzle and a second position for permitting the flow of liquid from said inlet defining means and through said nozzle for direction from said gun, said solenoid coil being selectively operable for moving said plunger from between said first and second positions, means for defining an air inlet for connection to a pressurized air source, and said housing and module defining an annular flow passageway for communicating pressurized air from said air inlet defining means to said nozzle.

20. A liquid spray gun comprising a housing, means defining a liquid inlet for connection to a pressurized liquid supply source, a discharge nozzle at an end of said housing, a solenoid coil supported within said housing, means for electrically coupling said solenoid coil to an electrical source, said housing having a two-part construction including a body and a removable elongated cover, said body being formed with a counterbore opening in a downstream direction, a control module mounted within said solenoid coil with an upstream end thereof disposed in said counterbore, said control module including a valve plunger movable between a first position for preventing the flow of liquid through said nozzle and a second position for permitting the flow of liquid from said inlet defining means and through said nozzle for direction from said gun, and said solenoid coil being selectively operable for moving said plunger from between said first and second positions.

21. The liquid spray gun of claim 20 including an annular seal disposed in said counterbore in interposed relation between said counterbore and an upstream end of said control module.

22. A liquid spray gun comprising a housing, means defining a liquid inlet for connection to a pressurized liquid supply source, a discharge nozzle at an end of said housing, a solenoid coil supported within said housing, means for electrically coupling said solenoid coil to an electrical source, a fluid control module disposed within said solenoid coil for controlling the flow of liquid from said inlet defining means through said nozzle, said control module including a valve plunger movable between a first position for preventing the flow of liquid through said nozzle and a second position for permitting the flow of liquid from said inlet defining means and through said nozzle for direction from said gun, said solenoid coil being selectively operable for moving said plunger from between said first and second positions, said control module further including a cylindrical core adjacent an upstream end of said valve plunger and a cylindrical tube extending forwardly of said core, said plunger being mounted for relative longitudinal movement within said tube, said control module further including a valve seat having a liquid discharge orifice, said valve seat being supported within a seat plug removably engageable with a downstream end of said tube, said core and valve plunger being formed with internal liquid flow passageways for permitting communication of liquid from said liquid inlet defining means to said valve seat, and said valve plunger being in seated engagement with said valve seat when in said first position to prevent liquid flow through said discharge orifice and in retracted relation to said valve seat when in said second position to permit the flow of liquid through said discharge orifice.

23. The liquid spray gun of claim 22 in which said nozzle is supported within a tip adaptor, and said tip adaptor is removably engageable with said seat plug.

24. A liquid spray gun comprising a housing, means defining a liquid inlet for connection to a pressurized liquid supply source, a discharge nozzle at an end of said housing, a solenoid coil supported within said housing, means for electrically coupling said solenoid coil to an electrical source, a fluid control module disposed within said solenoid coil for controlling the flow of liquid from said inlet defining means through said nozzle, said control module including a valve plunger movable between a first position for preventing the flow of liquid through said nozzle and a second position for permitting the flow of liquid from said inlet defining means and through said nozzle for direction from said gun, said solenoid coil being selectively operable for moving said plunger from between said first and second positions, said housing including means defining an air inlet for connection to a pressurized air source, said nozzle including a fluid tip through which liquid is directed, an air cap mounted downstream of said fluid tip and being formed with a discharge orifice, said solenoid coil being wound on a spool having an internal cylindrical opening, and said module and spool opening defining an air passageway for communicating pressurized air from said air inlet defining means to said air cap for assisting in atomization and direction of liquid discharging from said fluid tip.

25. A liquid spray gun of claim 24 in which said module includes a forward tubular portion within which said plunger is mounted for reciprocating movement, said air passageway between said spool and module communicating with a second air passageway defined between said forward tubular portion and housing, and passage means in said module for communicating pressurized air from said second air passageway to said air cap.

26. A liquid spray gun comprising a housing, means in said housing defining a liquid inlet for connection to a pressurized liquid source, means in said housing defining an air inlet for connection to a pressurized air source, a discharge nozzle at an end of said housing, means defining a liquid flow passage for communicating liquid from said liquid inlet defining means to said nozzle, a solenoid coil supported within said housing, means for electrically coupling said solenoid coil to an electrical source, a liquid control module including a valve plunger that is movable between a first position of preventing the flow of liquid through said nozzle and a second position for permitting the flow of liquid from said liquid inlet defining means through said liquid flow passage defining means and nozzle for direction from said spray gun, said solenoid coil being selectively operable for moving said control valve plunger between said first and second positions, and said module and housing defining an annular air flow passage within said housing for communicating pressurized air from said air inlet defining means to said nozzle for facilitating atomization and direction of liquid directed from said gun.

27. The liquid spray gun of claim 26, in which said control module includes a valve seat having a liquid discharge orifice, and said valve plunger being in seated engagement with said valve seat when in said first position to prevent liquid flow through said discharge orifice and said valve plunger being in retracted relation to said valve seat when in said second position to permit the flow of liquid through said discharge orifice.

28. A liquid spray gun comprising a housing, means in said housing defining a liquid inlet for connection to a pressurized liquid source, means in said housing defining an air inlet for connection to a pressurized air source, a discharge nozzle at an end of said housing, means defining a liquid flow passage for communicating liquid from said liquid inlet defining means to said nozzle, a solenoid coil supported within said housing, means for electrically coupling said solenoid coil to an electrical source, a control module removable and replaceable in said housing, said control module including a valve plunger and a cylindrical core adjacent an upstream end of said valve plunger, said core and valve plunger being formed with internal liquid flow passageways for permitting communication of liquid from said liquid inlet defining means to said nozzle, said valve plunger being movable between a first position for preventing the flow of liquid through said nozzle and a second position for permitting the flow of liquid from said liquid inlet defining means through said liquid flow passage and nozzle for direction from said spray gun, said solenoid coil being selectively operable for moving said valve plunger between said first and second positions, and means defining an air flow passage within said housing for communicating pressurized air from said air inlet defining means to said nozzle for facilitating atomization and direction of liquid directed from said gun.

29. A liquid spray gun comprising a housing, means in said housing defining a liquid inlet for connection to a pressurized liquid source, means in said housing defining an air inlet for connection to a pressurized air source, a discharge nozzle at an end of said housing, means defining a liquid flow passage for communicating liquid from said liquid inlet defining means to said nozzle, a solenoid coil supported within said housing, means for electrically coupling said solenoid coil to an electrical source, a liquid control module including a valve plunger that is movable between a first position for preventing the flow of liquid through said nozzle and a second position for permitting the flow of liquid from said liquid inlet defining means through said liquid flow passage and nozzle for direction from said spray gun, said solenoid coil being selectively operable for moving said valve plunger between said first and second positions, and said solenoid coil being wound on a spool having an internal cylindrical opening, said module and spool opening defining an air passageway for communicating pressurized sir from said air inlet defining means to said nozzle for facilitating atomization and direction of liquid directed from said gun.

30. In a can manufacturing operation in which cylindrical can bodies having a longitudinal welded seam are successively passed over a spray gun which directs a strip of atomized protective liquid over the welded seam area, said spray gun comprising a housing, means defining a liquid inlet for connection to a pressurized liquid supply source, means for defining an air inlet for connection to a pressurized air source, a discharge nozzle, a solenoid coil supported within said housing, means for electrically coupling said solenoid coil to an electrical source, a solenoid operated control module for controlling the flow of liquid from said inlet through said nozzle, said solenoid coil being selectively energizable for operating said control module, said control module being removable and replaceable from said housing, said housing and module defining an annular flow passageway for communicating pressurized air from said air inlet defining means to said nozzle for assisting in atomization and direction of liquid spray from said discharge nozzle.

31. A liquid spray gun comprising a housing, means defining a liquid inlet for connection to a pressurized liquid supply source, a solenoid coil supported within said housing, means for electrically coupling said solenoid coil to an electrical source, a fluid control module removably disposed within said housing for controlling the flow of liquid from said liquid inlet defining means through said nozzle, said control module including a core positionable within said solenoid coil, a tubular portion extending forwardly of said core, a valve seat carried by said tubular portion and having a liquid discharge orifice, and a valve plunger disposed within said tubular portion and moveable between a first position in seated engagement with said valve seat for preventing liquid flow through said discharge orifice and a second position in retracted relation to said valve seat for permitting the flow of liquid from said liquid defining means through said discharge orifice and for direction from said gun, said solenoid coil being selectively operable for moving said plunger between said first and second positions, and means for releasably retaining such module in properly disposed position in said housing and for permitting removal and replacement of said module.

32. The liquid spray gun of claim 31 in which said core and valve plunger are formed with internal liquid flow passageways for permitting communication of liquid from said liquid inlet defining means to said valve seat.

33. The liquid spray gun of claim 32 in which said valve plunger is moved into abutting relation to said core when in said second position.

34. The liquid spray gun of claim 32 in which said valve plunger liquid passageway communicates with an annular liquid flow passageway disposed about a downstream end of said plunger.

35. The liquid spray gun of claim 34 in which said valve plunger has a reduced diameter nose portion engageable with said valve seat, and said annular liquid flow passageway surrounds said valve plunger nose portion.

36. The liquid spray gun of claim 32 in which said module includes an adaptor mounted adjacent a downstream end thereof, a fluid tip disposed within said adaptor and being formed with a liquid discharge orifice, and said adaptor being formed with a passageway communicating between said valve seat discharge orifice and an upstream side of said fluid tip.

37. The liquid spray gun of claim 31 in which said module includes a spring for biasing said plunger to said first position.

38. The liquid spray gun of claim 31 in which said valve seat is disposed at a downstream end of said tubular portion.

39. The liquid spray gun of claim 31 including a spray nozzle mounted on a downstream end of the tubular portion of said module.

* * * * *